US007280793B2

(12) United States Patent
Zess et al.

(10) Patent No.: US 7,280,793 B2
(45) Date of Patent: Oct. 9, 2007

(54) FUSER ARRANGED FOR BRAKING AND AN IMAGE FORMING DEVICE INCLUDING THE SAME

(75) Inventors: Martin F. Zess, Churchville, NY (US); Mark S. Amico, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 182 days.

(21) Appl. No.: 11/298,242

(22) Filed: Dec. 9, 2005

(65) Prior Publication Data

US 2007/0134033 A1 Jun. 14, 2007

(51) Int. Cl.
*G03G 15/20* (2006.01)

(52) U.S. Cl. ..... 399/323; 399/328; 399/329

(58) Field of Classification Search ..... 219/216; 399/322, 323, 328, 329
See application file for complete search history.

(56) References Cited

U.S. PATENT DOCUMENTS

| | | | | |
|---|---|---|---|---|
| 3,716,221 | A | | 2/1973 | Gorka et al. |
| 3,934,113 | A | | 1/1976 | Bar-on |
| 4,042,804 | A | | 8/1977 | Moser |
| 5,268,559 | A | * | 12/1993 | Jacobs ..... 219/216 |
| 5,623,720 | A | | 4/1997 | Howe et al. |
| 5,697,036 | A | * | 12/1997 | Moser ..... 399/329 |
| 5,822,668 | A | | 10/1998 | Fromm et al. |
| 5,873,020 | A | * | 2/1999 | Matsuura et al. ..... 399/329 |
| 6,490,428 | B1 | | 12/2002 | Fromm et al. |
| 6,782,228 | B1 | | 8/2004 | Rasch et al. |
| 6,782,233 | B2 | | 8/2004 | Condello et al. |
| 6,785,503 | B2 | | 8/2004 | Kuo et al. |
| 6,963,717 | B1 | | 11/2005 | Klimley et al. |
| 2003/0039491 | A1 | | 2/2003 | Bogoshian |
| 2005/0156377 | A1 | | 7/2005 | Jacobs |

* cited by examiner

*Primary Examiner*—Hoang Ngo
(74) *Attorney, Agent, or Firm*—Wayne J. Egan

(57) ABSTRACT

A fuser assembly includes a pressure member motion speed reduction device which slows the pressure member speed when the printed paper lead edge exits the nip. The temporarily slower pressure member speed stretches or retards the surface of the fusing member elastomer enough to assist in peeling the lead edge from the fusing member thereby allowing the rest of the paper to peel off. In one embodiment, the paper stripping or peeling process is assisted by means of one or more air knives, one or more stripping fingers, or any combination of these items.

32 Claims, 4 Drawing Sheets

FUSER ARRANGED FOR BRAKING AND AN IMAGE FORMING DEVICE INCLUDING THE SAME

INCORPORATION BY REFERENCE OF OTHER U.S. PATENTS

The disclosures of the following twelve (12) U.S. Patent Documents hereby are incorporated by reference, verbatim, and with the same effect as though the same disclosures were fully and completely set forth herein:

U.S. Pat. No. 6,963,717 B1, "Fuser stripper baffle and a printing machine including the same", issued 8 Nov. 2005 to William R. Klimley et al., assigned to Xerox Corporation;

U.S. Pat. No. 6,785,503 B2, "Stripper fingers and roller assembly for a fuser in a printing apparatus", issued 31 Aug. 2004 to Youti Kuo et al., assigned to Xerox Corporation;

U.S. Pat. No. 6,782,233 B2, "Externally heated thick belt fuser", issued 24 Aug. 2004 to Anthony S. Condello et al., assigned to Xerox Corporation;

U.S. Pat. No. 6,782,228 B1, "Intermittent stripper fingers and baffle for stripping copy media from a heated fuser roll", issued 24 Aug. 2004 to Kenneth R. Rasch et al., assigned to Xerox Corporation;

U.S. Pat. No. 6,490,428 B1, "Stripper fingers and associated mounts for a fuser in a printing apparatus", issued 3 Dec. 2002 to Paul M. Fromm et al., assigned to Xerox Corporation;

U.S. Pat. No. 5,822,668, "Fuser subsystem module for an electrophotographic printer which pivots open for jam clearance", issued 13 Oct. 1998 to Paul M. Fromm et al., assigned to Xerox Corporation;

U.S. Pat. No. 5,623,720, "Method and apparatus for stripper bar rotation", issued 22 Apr. 1997 to Richard L. Howe et al., assigned to Xerox Corporation;

U.S. Pat. No. 4,042,804, "Roll fuser apparatus", issued 16 Aug. 1977 to Rabin Moser, assigned to Xerox Corporation;

U.S. Pat. No. 3,934,113, "Roll fuser apparatus and mounting arrangement therefor", issued 20 Jan. 1976 to Ari Bar-on, assigned to Xerox Corporation;

U.S. Pat. No. 3,716,221, "Fusing device", issued 13 Feb. 1973 to Donald J. Gorka et al.;

U.S. Patent Application Publication No. US 2005/0156377 A1, "Fuser sheet stripping system", published 21 Jul. 2005 by Robert M. Jacobs; and U.S. Patent Application Publication No. US 2003/0039491 A1, "Multi-function air knife", published 27 Feb. 2003 by Gregory V. Bogoshian.

BACKGROUND OF THE INVENTION

The present disclosure pertains to fusers and methods for stripping printed papers from a fusing member.

As is known, in a typical electrophotographic copying or printing process, a charged photoconductor is exposed to form an electrostatic latent image. As described aforementioned U.S. Pat. No. 6,782,233 to Anthony S. Condello et al. ("Condello"), at col. 1, lines 12-41, this latent image is then developed by bringing a developer material such as toner in contact therewith. The toner is deposited as a latent electrostatic image on the photoconductor. The toner image is then transferred from the photoconductor to a copy substrate such as, for example, paper or another media. In order to fix or fuse the toner onto the media permanently by heat, the toner material is heated to cause the toner to flow onto the fibers or pores of the media. Thereafter, as the toner cools, the toner solidifies, thus causing the toner to permanently bond to the media.

Typical fusing arrangements are described in the foregoing Condello patent, especially from col. 1, line 42 to col. 4, line 9.

It is known to use one or more stripper fingers to separate, sever or "strip" a printed paper from a heated fusing member. For example, the aforementioned U.S. Pat. No. 6,963,717 to William R. Klimley et al. depicts in FIG. 1 a fuser stripper baffle 20 comprising individual stripper baffle fingers 10.1 through 10.7 arranged to strip a paper sheet 30 from a fuser roll 10. The stripping process is depicted in FIG. 3.

Further, the aforementioned U.S. Pat. No. 6,785,503 to Youti Kuo et al. depicts in FIG. 4 a set of stripper fingers 30 arranged to lift a printed sheet off a fuser roll 10 near the nip 14 as the sheet passes therethrough.

Further, the aforementioned U.S. Pat. No. 6,782,228 to Kenneth R. Rasch et al. depicts in FIGS. 13 and 14 a plurality of stripper finger assemblies 40 arranged to strip printed papers from the heated fuser roll 12. As described at col. 5, lines 46-56, each stripper finger assembly comprises a base member 42 fabricated from a suitable plastic or metal material. A leaf spring 44 is mounted at one end on the base member 42 and has affixed to its free end a plastic tip 46 that always contacts the heated fuser roll.

Further, the aforementioned U.S. Pat. No. 6,490,428 B1, "Stripper fingers and associated mounts for a fuser in a printing apparatus", issued 3 Dec. 2002 to Paul M. Fromm et al. depicts in FIG. 5 a plurality of stripper fingers 30 arranged to strip a printed sheet from a fuser apparatus comprising a fuser roll 10 and a pressure roll 12.

Further, the aforementioned U.S. Pat. No. 5,822,668, "Fuser subsystem module for an electrophotographic printer which pivots open for jam clearance", issued 13 Oct. 1998 to Paul M. Fromm et al. depicts in FIG. 1 one or more stripper fingers 16 disposed across a longitude of fuser roll 12 and arranged to strip printed sheets from the surface of fuser roll 12.

Further, the aforementioned U.S. Pat. No. 5,623,720 to Richard L. Howe et al. depicts in FIG. 4 one or more stripper fingers 104 spring-biased towards a heated fuser roller 54 and arranged to strip printed sheets from the surface of fuser roll 54.

Further, the aforementioned U.S. Pat. No. 4,042,804 to Rabin Moser depicts in FIG. 1 one or more stripper fingers 68 which are arranged to ensure removal of the printed substrate 35 from the fuser assembly 15 as the substrate passes through the nip 34 that is created by the heated fuser roll 30 and the included cooperating pressure or backup roll 33.

Further, the aforementioned U.S. Pat. No. 3,934,113 to Ari Bar-on depicts in FIGS. 4 and 8 a plurality of L-shaped stripper fingers 134 arranged to strip a printed sheet 14 from a fuser assembly 15 comprising a heated fuser roll 30 and a corresponding pressure or backup roll 32 which cooperate to form a nip 33. An alternate form of stripper finger may be employed comprising the stripper fingers 142 as depicted in FIG. 9. See also Bar-on's written description from col. 7, line 32 to col. 8, line 6.

It is also known to use one or more air knives to strip a printed paper from a fusing member. For example, the aforementioned U.S. Patent Application Publication No. 2005/0156377 by Robert M. Jacobs ("Jacobs") depicts in FIG. 3 a stripper finger 26 that includes an internal pneumatic conduit or air channel 27 therein extending from a flexible hose or other pneumatic connection to conventional or existing machine blower 30. As described in paragraph 0018, this internal conduit or air channel 27 extends all the way out to closely to the stripping edge 27, where this air channel 27 has an upwardly directed opening 28, for blowing air under the leading edge 14 of the printed sheet 12 up away from the fuser roll 24 and towards the normal downstream sheet path in cooperation with the stripper finger 26 stripping edge 27 catching and lifting of that same sheet leading edge 14, thereby effectively increasing the radius of the sheet 12 leading edge 14 in the stripping area which would be created by the mechanical stripper finger 26, thereby reducing the chance of the sheet 12 lead edge folding up and jamming at that location, rather than stripping off into the downstream sheet path, as shown by dot-dashed lines and motion arrows in FIGS. 2 and 3 of Jacobs.

Further, the aforementioned U.S. Patent Application Publication No. 2003/0039491 by Gregory V. Bogoshian ("Bogoshian") depicts in FIGS. 5 and 6 a corrugating air knife 400. As described in paragraph 0032, the corrugating air knife 400 comprises a manifold 401 that directs a stream of air across the width of the printed sheet 52 as the sheet exits the fuser arrangement comprising the heated fusing roll 62 and the included cooperating pressure roll 64. The air knife 400 includes extra ribs 402 formed which have an air passage integral to the rib 402, as shown in FIG. 5. The localized stream of air flowing from the ribs 402 causes a lightweight paper sheet to corrugate due to the air stream that increases the beam strength of the sheet and prevents the lead edge of the sheet 152 from folding over and wrapping around the fusing roll 62.

Further, the aforementioned U.S. Pat. No. 3,716,221 to Donald J. Gorka et al. ("Gorka") depicts in FIGS. 1 and 4 an air knife 87 and a stripping and guide blade 88 arranged to strip a printed sheet from the nip area formed between the fusing roller 10 and the cooperating pressure or backup roller 12. See also Gorka's written description at col. 6, lines 31-59.

Currently, papers processed through xerographic printing machines have a tendency to stick to the fusing roll as excessive toner builds up onto the fusing roll. In order to counteract this problem, an air knife is used to help strip the lead edge from the fuser roll. If the lead edge has a problem stripping from the roll then the air knife baffle is supposed to help strip the paper from the fuser roll. Notwithstanding these stripping actions, further stripping improvements are still possible.

Thus, there is a need for the present invention.

BRIEF SUMMARY OF THE INVENTION

In a first aspect of the invention, there is described a fuser arranged for braking, the fuser comprising a fusing member and a pressure member, wherein the fusing member and the pressure member cooperate to form a nip, the fuser arranged with an included sensor and an included pressure member braking means, the sensor indicating when a leading edge of an included paper sheet exits the nip and thereupon providing a sensor output signal to the pressure member braking means; the pressure member braking means providing, based on the sensor output signal, a braking action with respect to an included pressure member motion.

In a second aspect of the invention, there is described an image forming device including a fuser arranged for braking, the fuser comprising a fusing member and a pressure member, wherein the fusing member and the pressure member cooperate to form a nip, the fuser arranged with an included sensor and an included pressure member braking means, the sensor indicating when a leading edge of an included paper sheet exits the nip and thereupon providing a sensor output signal to the pressure member braking means; the pressure member braking means providing, based on the sensor output signal, a braking action with respect to an included pressure member motion.

BRIEF DESCRIPTION OF THE SEVERAL VIEWS OF THE DRAWING

In FIG. 2 the fusing member comprises the fusing roller 10 as shown. Also in FIG. 2, the pressure member comprises the pressure roller 20 as shown. As shown, the fuser arrangement 100 further comprises a sensor 50 and a pressure member braking means 60. The sensor 50 comprises an arrangement of one or more optical sensing devices, one or more mechanical sensing devices, or any combination of these items. Also shown is an optional stripping assisting arrangement 70 comprising any of one or more air knives, one or more stripping fingers, or any combination of the foregoing items.

In FIG. 3 the fuser member comprises the fusing roller 10 arranged with a fusing belt 90 as shown. In one embodiment the arrangement of the fusing roller 10 and the fusing belt 90 as depicted in FIG. 3 is similar to the belt fusing arrangement 10 as described in the aforementioned U.S. Pat. No. 6,782,233 B2 to Anthony S. Condello et al. Also in FIG. 3, the pressure member comprises the pressure roller 20 arranged with a pressure belt 80 as shown. As shown, the fuser arrangement 100 further comprises the sensor 50 and pressure member braking means 60 of FIG. 2. Also shown is the optional stripping assisting arrangement 70 of FIG. 2.

DETAILED DESCRIPTION OF THE INVENTION

Briefly, a fuser assembly includes a pressure member motion speed reduction device such as, for example, a torque clutch or brake, which slows the pressure member speed when the printed paper lead edge exits the nip. The temporarily slower pressure member speed stretches or retards the surface of the fusing member elastomer enough to assist in peeling the lead edge from the fusing member thereby allowing the rest of the paper to peel off. In one embodiment, the paper stripping or peeling process is assisted by means of one or more air knives, one or more stripping fingers, or any combination of these items.

Figure 1:
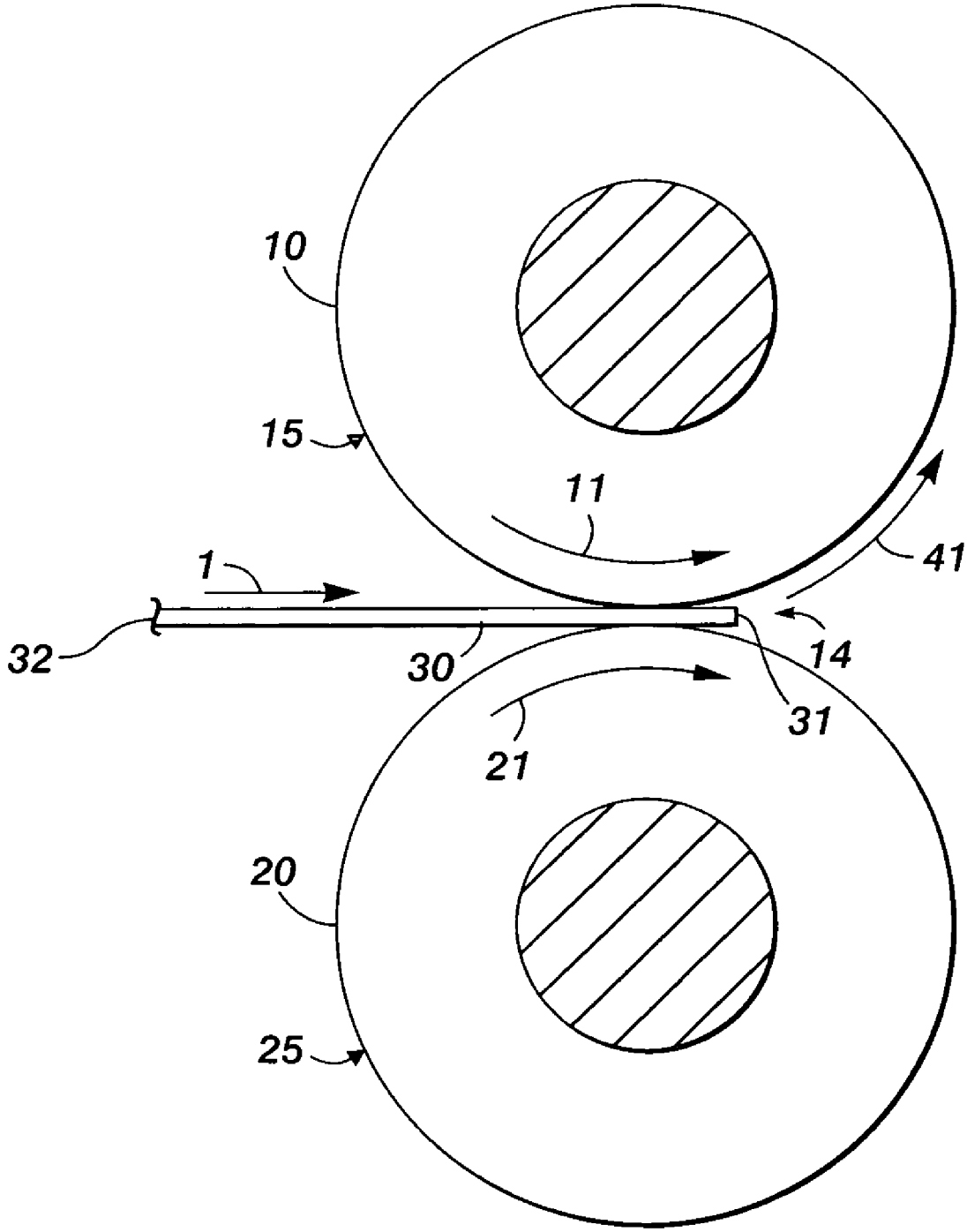
FIG. 1 PRIOR ART
FIG. 1 is a cutaway profile attached view of a fuser comprising a fusing member 10 and a pressure member 20. As shown, the fusing member or fusing roller 10 and the pressure member or pressure roller 20 cooperate to form a nip 14. A printed paper sheet 30 travels through the nip 14 in a downstream or process direction depicted by the arrow 1.

Referring now to FIG. 1, there is shown a cutaway profile attached view of a current fuser arrangement 100 comprising a heated fusing member 10 and a pressure member 20. A printed paper sheet 30 is depicted as moving or traveling in a downstream or process direction depicted by the arrow 1.

As shown, the fusing member 10 contacts the pressure member 20 along a longitude thereof, the fusing member 10 and the pressure member 20 cooperating to form a nip 14 therebetween. As is familiar in the art, the printed sheet 30, such as created by xerographic printing, is pulled through the nip by the angular motion 11 of the fusing member 10 and the cooperating angular motion 21 of the pressure member 20.

Typically the freshly-fused marking material, such as toner, on the print sheet, which is facing up in the view of FIG. 1, may cause the sheet to stick to the surface of fusing member 10 even after passing through nip 14, such paper sheet 30 fusing member 10 surface sticking or adhering being depicted in FIG. 1 by reference number 41. In FIG. 1 the fusing member 10 outer periphery 15 moves at a surface speed of "X" and the pressure member 20 outer periphery 25 moves at a surface speed of "Z".

Figure 2:
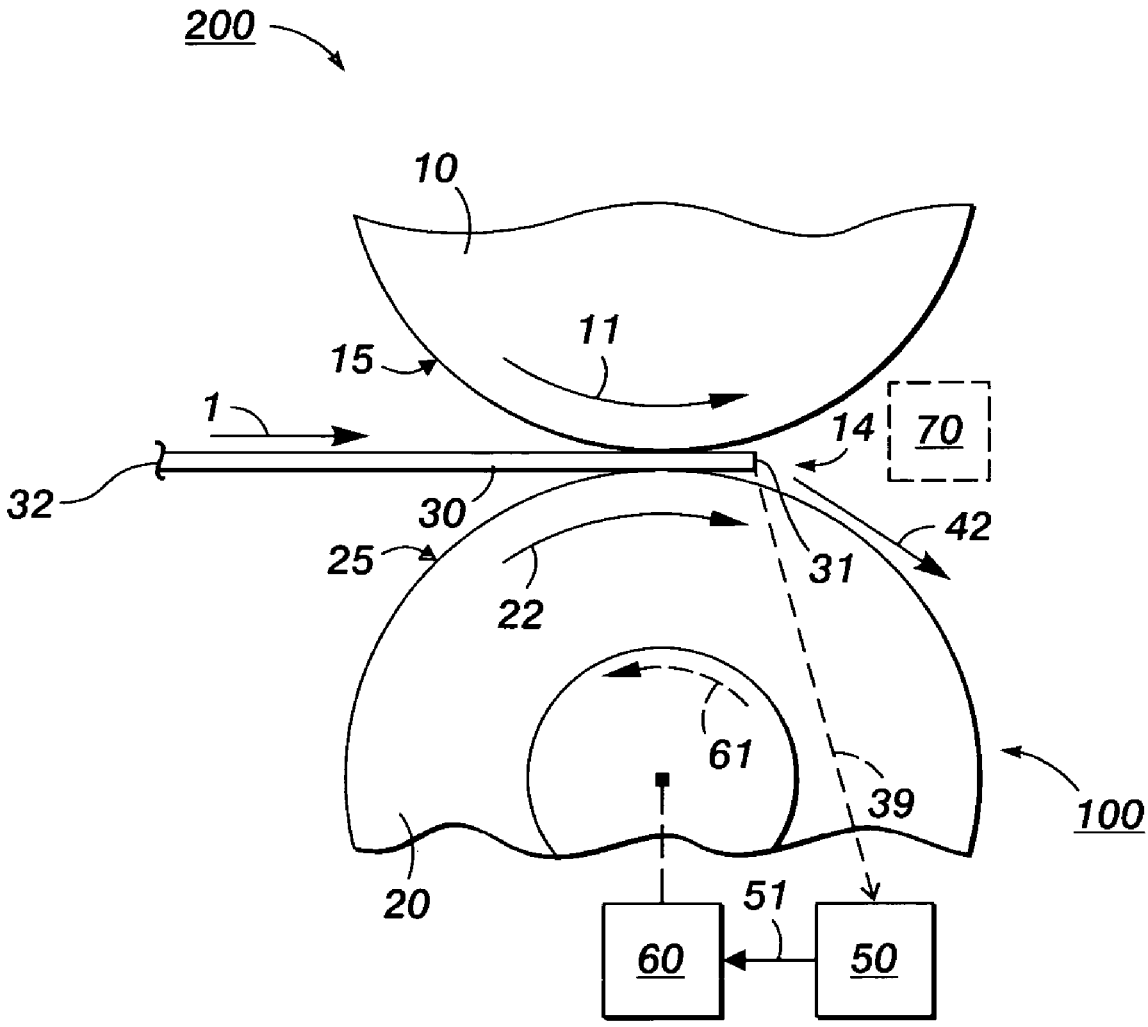
FIG. 2 is a cutaway profile attached view of an image forming device 200. In turn, the image forming device 200 includes a first embodiment of an arrangement 100 of a fuser arranged for braking, in accordance with the present invention. As shown, the fuser comprises a fusing member and a pressure member.

Referring now to FIG. 2, there is shown a cutaway profile attached view of an image forming device 200 including a fuser braking arrangement 100. As mentioned above, the FIG. 2 fuser uses a roller fusing member comprising the roller 10 as shown. Also, FIG. 2 fuser uses a roller pressure member comprising the roller 20 as shown. The fuser braking arrangement 100 also includes the sensor 50 and the pressure member braking means 60 arranged as shown.

Figure 3:
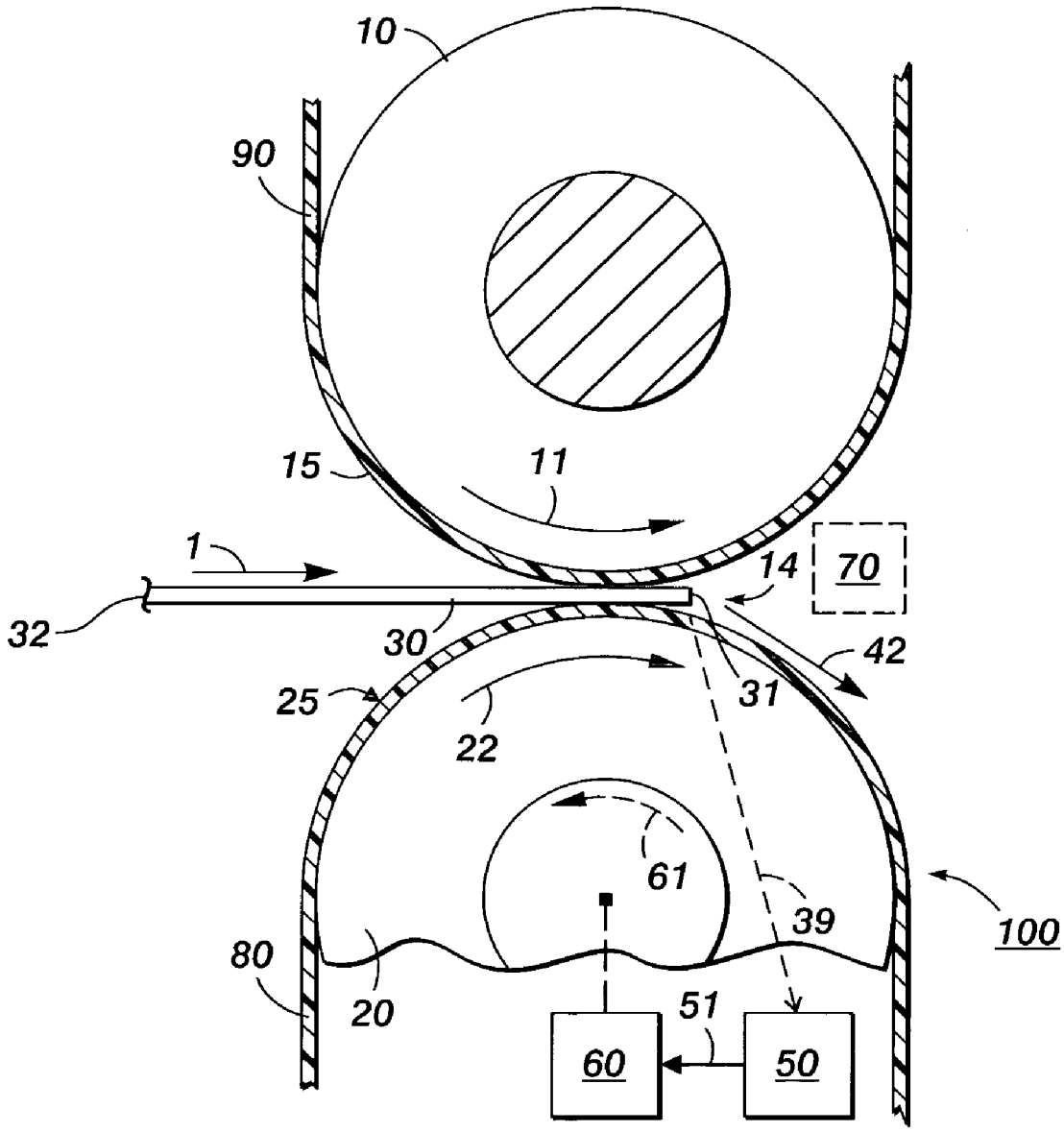
FIG. 3 is a cutaway profile attached view of a second embodiment of an arrangement 100 of a fuser arranged for braking, in accordance with the present invention. As shown, the fuser comprises a fusing member and a pressure member.

Referring now to FIG. 3, there is shown a cutaway profile attached view of an alternate embodiment of the fuser braking arrangement 100 of FIG. 2. As mentioned above, the FIG. 3 fuser uses a belt fusing member comprising the roller 10 and the belt 90 as shown. Also, the FIG. 3 fuser uses a belt pressure member comprising the roller 20 and the belt 80 as shown.

Referring generally to FIGS. 2-3, the operation of the fuser braking arrangement 100 is now described.

When the paper sheet leading edge 31 exits the nip 14, this leading edge 31 exiting nip event 39 is indicated by the sensor 50.

Based on the aforementioned detecting of the leading edge 31 nip 14 exiting event 39, the sensor 50 provides a sensor output signal 51 to the pressure member braking means 60.

Based on receiving this sensor output signal 51, the pressure member braking means 60 provides, applies, causes or initiates a braking action or force 61 with respect to the pressure member's depicted angular motion 22.

Based on the braking action or force 61, the pressure member's angular motion 22 is thereby diminished, reduced, decreased, retarded, lessened or slowed.

Based on the diminished, reduced, decreased, retarded, lessened or slowed pressure member's angular motion 22 speed, the surface of the fusing member's elastomer is caused to stretch or retard enough to assist in peeling the lead edge 31 from the fusing member, thereby allowing the rest of the paper 30 to peel-off, sever or separate from the surface of the fusing member.

Thus, in FIG. 2 the resulting paper sheet 30's peeling-off, severing or separating from the fusing member's roller 10 surface is depicted by reference number 42.

Further, in FIG. 3 the resulting paper sheet 30's peeling-off, severing or separating from the fusing member's belt 90 surface likewise is depicted by reference number 42.

Still referring generally to FIGS. 2-3, in one embodiment the paper stripping process 42 is further assisted by means of an included optional stripping assisting arrangement 70. The stripping assisting arrangement 70, in turn, comprises any of one or more air knives, one or more stripping fingers, or any combination of the foregoing items.

In one embodiment, the stripping assisting arrangement 70 comprises an air knife similar to the air knife 26 as described hereinabove in connection with U.S. Patent Application Publication No. 2005/0156377 by Robert M. Jacobs.

In another embodiment, the stripping assisting arrangement 70 comprises an air knife similar to the air knife 400 as described hereinabove in connection with U.S. Patent Application Publication No. 2003/0039491 by Gregory V. Bogoshian.

In a further embodiment, the stripping assisting arrangement 70 comprises an air knife similar to the air knife 87 and stripping and guide blade 88 as described hereinabove in connection with U.S. Pat. No. 3,716,221 to Donald J. Gorka et al.

In still another embodiment, the stripping assisting arrangement 70 comprises a fuser stripper baffle similar to the fuser stripper baffle 20 as described hereinabove in connection with U.S. Pat. No. 6,963,717 to William R. Klimley et al.

In yet a further embodiment, the stripping assisting arrangement 70 comprises a set of stripper fingers similar to the set of stripper fingers 30 as described hereinabove in connection with U.S. Pat. No. 6,785,503 to Youti Kuo et al.

In yet another embodiment, the stripping assisting arrangement 70 comprises a plurality of stripper finger assemblies similar to the plurality of stripper finger assemblies 40 as described hereinabove in connection with U.S. Pat. No. 6,782,228 to Kenneth R. Rasch et al.

In still a further embodiment, the stripping assisting arrangement 70 comprises a plurality of stripper fingers similar to the plurality of stripper fingers 30 as described hereinabove in connection with U.S. Pat. No. 6,490,428 B1 to Paul M. Fromm et al.

In still another embodiment, the stripping assisting arrangement 70 comprises stripper fingers similar to the stripper fingers 16 as described hereinabove in connection with U.S. Pat. No. 5,822,668 to Paul M. Fromm et al.

In a yet still further embodiment, the stripping assisting arrangement 70 comprises one or more stripper fingers similar to the one or more stripper fingers 104 as described hereinabove in connection with U.S. Pat. No. 5,623,720 to Richard L. Howe et al.

In a yet still another embodiment, the stripping assisting arrangement 70 comprises one or more stripper fingers similar to the one or more stripper fingers 68 as described hereinabove in connection with U.S. Pat. No. 4,042,804 to Rabin Moser.

In yet a further another embodiment, the stripping assisting arrangement 70 comprises stripper fingers similar to any of the plurality of L-shaped stripper fingers 134 and the stripper fingers 142 as described hereinabove in connection with U.S. Pat. No. 3,934,113 to Ari Bar-on.

As shown generally in FIGS. 2-3, the pressure member braking means 60 is arranged to provide a pressure member angular motion braking 61 which, in turn, diminishes, reduces, decreases, retards, lessens or slows the pressure member's angular motion 22 when only the printed paper lead edge 31 exits the nip 14. The resulting temporarily slower pressure member's angular speed 22 stretches or retards the surface of the fusing roller 10 in FIG. 2 or fusing belt 90 in FIG. 3 elastomer enough to assist in peeling the lead edge 31 from the fusing roller 10 in FIG. 2 or fusing belt 90 in FIG. 3 thereby allowing the rest of the paper 30 to peel-off the surface of the fusing roller 10 in FIG. 2 or fusing belt 90 in FIG. 3, such paper sheet 30 peeling-off or severing being depicted in FIGS. 2-3 by reference number 42. In one embodiment, the paper peeling process 42 is assisted by means of an included optional arrangement 70 comprising any of one or more air knives, one or more stripping fingers, or any combination of the foregoing items.

Still referring to FIGS. 2-3, as a result of the pressure member angular motion 22 braking 61 being provided by the pressure member braking means 60, the fusing roller 10's outer periphery 15 in FIG. 2 or fusing belt 90 in FIG. 3 remains at a surface speed of X whereas, in contrast, the pressure roller 20's outer periphery 25 in FIG. 2 or pressure belt 80 in FIG. 3 now moves at a reduced surface speed, Z', which equals Z−(Y %×Z), where Y is the percent desired speed difference and Z is the unconstrained pressure roller rotational speed. Hence, as the pressure roller 20's angular motion speed 22 in FIG. 2 or the pressure belt 80's speed in FIG. 3 is momentarily less than the unconstrained pressure roller 20's angular motion speed in FIG. 2 or the unconstrained pressure belt 80's speed in FIG. 3, there is provided to the printed paper 30 a force that assists the printed paper 30 leading edge 31 to peel-off, separate, sever or strip from the surface of the fusing roller 10 in FIG. 2 or the fusing belt 90 in FIG. 3, such peeling-off, separating, severing or stripping from the surface of the fusing member 10 being depicted in FIGS. 2-3 by reference number 42.

As mentioned above, the pressure member motion braking 61 is applied when the paper leading edge 31 exits the nip 14.

Referring still to FIGS. 2-3, in one embodiment the sensor 50 comprises an optical sensor arranged to indicate the paper leading edge 31 exiting the nip 14. Using an optical sensor provides multiple advantages. One factor is the optical sensor's fast response time, critical for high-speed printers. A second factor is the sensor does not damage the sheet being detected, as a mechanical sensor could. A third factor is the no de-bouncing which is a factor in mechanical switches.

Upon detecting the leading edge 31 exiting 39 the nip 14, the braking action or force 61 begins. The physical distance between the sheet's detection by the pre-fuser switch and the fusing nip entrance can be arbitrary. Therefore, the critical braking function 61 needs to occur as the media edge 31 exits 39 the fusing nip 14.

In one embodiment, the braking means 60 of comprises an electromagnetic brake or clutch similar to the device 60' depicted in FIG. 3. Providing the pressure member motion 22 braking 61 by means of an electromagnetic brake or clutch provides the following advantages:

First, an electromagnetic brake or clutch lends itself well to a digital electronic signal; and Second an electromagnetic brake or clutch is comprised of mature technology.

In one embodiment, the magnitude of the pressure member angular motion 22 braking 61 is determined by a required percentage of elastomer elongation, that is to say, the force required to stretch the elastomer at the nip exit from zero to a maximum allowable elastomer stress. The expected percentage of stretch required to properly strip the paper sheet 30 could range between 0.1% (0.001) and 20% (0.20), yet higher percentages may need to be applied in specific conditions.

In one embodiment, the time duration or period during which the pressure member motion braking 61 is applied to the pressure member angular motion 22 is momentary and temporary and is removed when the paper leading edge 31 becomes satisfactorily severed, peeled-off, separated or stripped from the surface of the fusing member 10. In other words, the pressure member motion braking 61 is removed and thereby ceases when it is no longer required.

In one embodiment, the maximum time duration or period during which the pressure member motion braking 61 is applied to the pressure member motion 22 is until the paper sheet trailing edge 32 exits the nip 14.

In one embodiment, the magnitude of the pressure member motion braking 61 is constant with time.

In another embodiment, the magnitude of the pressure member motion braking 61 varies with time.

Still referring to FIG. 2, in one embodiment the image forming device 200 comprises a printer or printing machine.

Still referring to FIG. 2, in one embodiment the image forming device 200 comprises a copier or copying machine.

Still referring to FIG. 2, in one embodiment the image forming device 200 comprises a fax or facsimile machine.

In summary, the pressure member, corresponding to reference number 20 in FIG. 2 and reference numbers 20 and 80 in FIG. 3, includes a braking means 60 so that the speed 22 of the pressure member is slowed in relation to the speed 11 of the fusing member, corresponding to reference number 10 in FIG. 2 and reference numbers 10 and 90 in FIG. 3. This speed difference results in placing a force on the paper 30 as it exits the nip 14 such that the paper 30 is pulled 42 from the fusing member.

Thus, there is described a pressure member motion speed reduction device 60 such as, for example, a torque clutch or brake, which slows the pressure member, corresponding to reference number 20 in FIG. 2 and reference numbers 20 and 80 in FIG. 3, for a short time when the paper lead edge 31 exits the nip 14. The temporarily slower speed 22 of the pressure member would stretch or retard the elastomer surface of the fusing member, corresponding to reference number 10 in FIG. 2 and reference numbers 10 and 90 in FIG. 3, enough to assist in peeling 42 the lead edge 31 from the fusing member.

Thus, there is described the first aspect of the invention, namely, a fuser arranged for braking 100, the fuser comprising a fusing member (corresponding to element 10 in FIG. 2 or to elements 10 and 90 in FIG. 3) and a pressure member (corresponding to element 20 in FIG. 2 or to elements 20 and 80 in FIG. 3), wherein the fusing member and the pressure member cooperate to form a nip 14, the fuser arranged with an included sensor 50 and an included pressure member braking means 60, the sensor indicating when a leading edge 31 of an included paper sheet exits 39 the nip and thereupon providing a sensor output signal 51 to the pressure member braking means 60; the pressure member braking means providing, based on the sensor output signal 51, a braking action 61 with respect to an included pressure member motion 22.

The following fourteen (14) sentences labeled A through N apply to the foregoing first aspect of the invention:

A. In one embodiment, the fusing member comprises a fusing roller 10.

B. In one embodiment, the fusing member comprises a fusing belt 90.

C. In one embodiment, the pressure member comprises a pressure roller 20.

D. In one embodiment, the pressure member comprises a pressure belt 80.

E. In one embodiment, based on the braking action 61, the motion 22 of the pressure member is thereby reduced, thus forming a reduced pressure member motion.

F. In one embodiment, based on the reduced pressure member motion, the surface of the fusing member elastomer is caused to stretch, thus forming a stretched fusing member elastomer.

G. In one embodiment, based on the stretched fusing member elastomer, the paper lead edge 31 is thus peeled, severed, separated or stripped from the surface of the fusing member.

H. In one embodiment the sensor 50 comprises an optical sensor, a mechanical sensor, or both.

Figure 4:
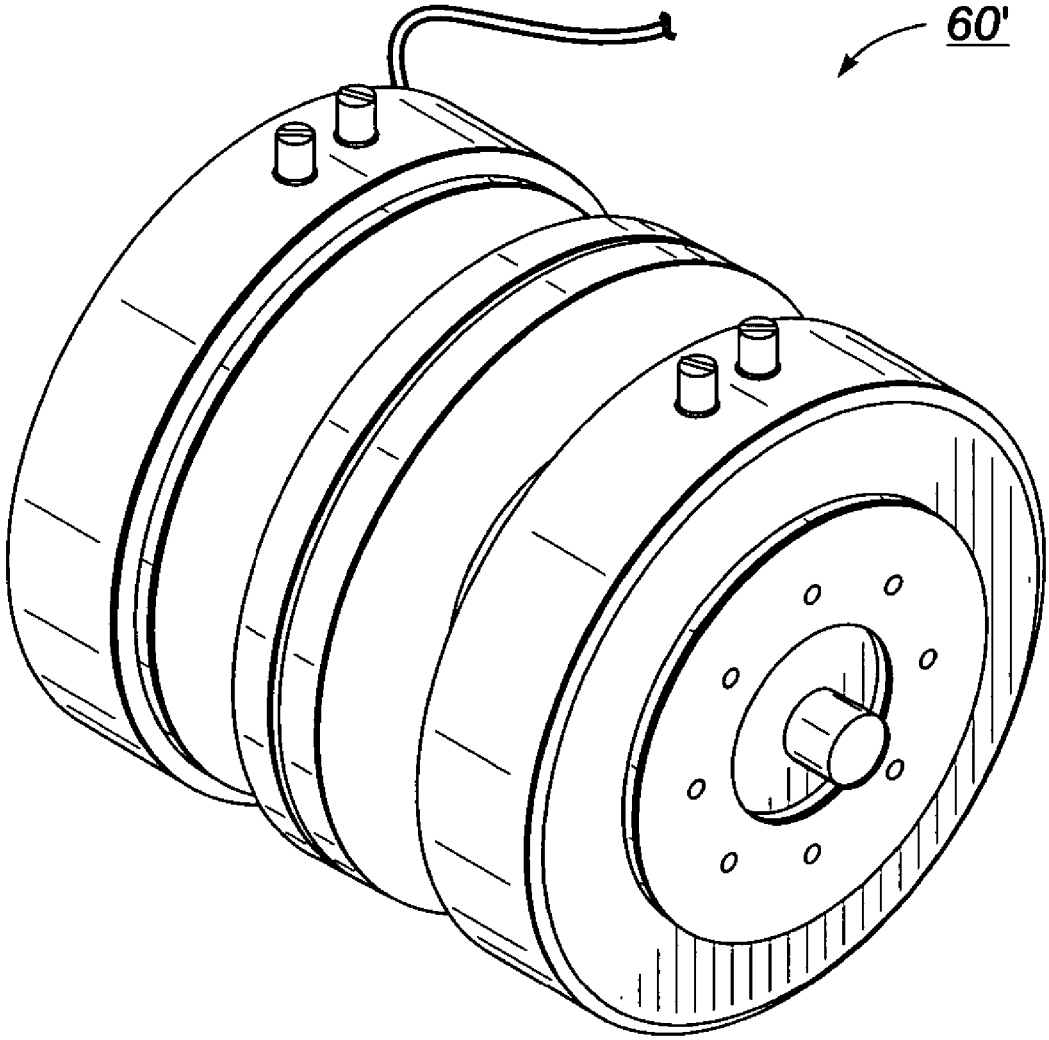
FIG. 4 is an elevated perspective detached view of an electromagnetic brake or clutch embodiment 60' of the pressure member braking means 60 of FIGS. 2 and 3.

I. In one embodiment, the pressure member braking means 60 comprises an electromagnetic brake or clutch device 60' as depicted in FIG. 4.

J. In one embodiment, there is included a stripping assisting arrangement 70 comprising any of one or more air knives, one or more stripping fingers, or any combination of these items.

K. In one embodiment, the magnitude of the pressure member braking 61 corresponds to a percentage of fusing member elastomer elongation that ranges between 0.1% and 20%.

L. In one embodiment, the duration or period of time during which the pressure member braking 61 is applied is based on when the paper leading edge 31 becomes satisfactorily stripped from the surface of the fusing member.

M. In one embodiment, the magnitude of the pressure member braking 61 is constant with time.

N. In one embodiment, the magnitude of the pressure member braking 61 varies with time.

Also, there is described the second aspect of the invention, namely, an image forming device 200 including a fuser arranged for braking 100, the fuser comprising a fusing member (corresponding to element 10 in FIG. 2 or to elements 10 and 90 in FIG. 3) and a pressure member (corresponding to element 20 in FIG. 2 or to elements 20 and 80 in FIG. 3), wherein the fusing member and the pressure member cooperate to form a nip 14, the fuser arranged with an included sensor 50 and an included pressure member braking means 60, the sensor indicating when a leading edge 31 of an included paper sheet exits 39 the nip and thereupon providing a sensor output signal 51 to the pressure member braking means 60; the pressure member braking means providing, based on the sensor output signal 51, a braking action 61 with respect to an included pressure member motion 22.

The following sixteen (16) sentences labeled O through DD apply to the foregoing second aspect of the invention:

O. In one embodiment, the fusing member comprises a fusing roller 10.

P. In one embodiment, the fusing member comprises a fusing belt 90.

Q. In one embodiment, the pressure member comprises a pressure roller 20.

R. In one embodiment, the pressure member comprises a pressure belt 80.

S. In one embodiment, based on the braking action 61, the motion 22 of the pressure member is thereby reduced, thus forming a reduced pressure member motion.

T. In one embodiment, based on the reduced pressure member motion, the surface of the fusing member elastomer is caused to stretch, thus forming a stretched fusing member elastomer.

U. In one embodiment, based on the stretched fusing member elastomer, the paper lead edge 31 is thus peeled, severed, separated or stripped from the surface of the fusing member.

V. In one embodiment, the sensor 50 comprises an optical, a mechanical sensor, or both.

W. In one embodiment, the pressure member braking means 60 comprises an electromagnetic brake or clutch device 60' as depicted in FIG. 4.

X. In one embodiment, there is included a stripping assisting arrangement 70 comprising any of one or more air knives, one or more stripping fingers, or any combination of these items.

Y. In one embodiment, the magnitude of the pressure member braking 61 corresponds to a percentage of fusing member elastomer elongation that ranges between 0.1% and 20%.

Z. In one embodiment, the duration or period of time during which the pressure member braking 61 is applied is based on when the paper leading edge 31 becomes satisfactorily stripped from the surface of the fusing member.

AA. In one embodiment, the magnitude of the pressure member braking 61 is constant with time.

BB. In one embodiment, the magnitude of the pressure member braking 61 varies with time.

CC. In one embodiment, the image forming device 200 comprises a printer or printing machine.

DD. In one embodiment, the image forming device 200 comprises a copier or copying machine.

The table below lists the drawing element reference numbers together with their corresponding written description:

| Ref. No.: | Description: |
|---|---|
| 1 | downstream or process direction |
| 10 | fusing roller |
| 11 | fusing member motion |
| 14 | nip |
| 15 | fusing member outer periphery |
| 20 | pressure roller |
| 21 | pressure member motion |
| 22 | braked pressure member motion |
| 25 | pressure member outer periphery |
| 30 | paper or media sheet |
| 31 | paper sheet leading edge |
| 32 | paper sheet trailing edge |
| 39 | exiting of paper sheet leading edge 31 from nip 14 |
| 41 | fusing-member-adhering paper path travel direction |
| 42 | braked paper path travel direction |
| 50 | sensor |
| 51 | sensor output signal |
| 60 | braking means |
| 60' | electromagnetic brake or clutch |
| 61 | pressure member motion braking action or force |
| 70 | optional stripping assisting arrangement |
| 80 | pressure belt |
| 90 | fusing belt |
| 100 | fuser arranged for braking |
| 200 | image forming device including the fuser arranged for braking |

While various embodiments of a fuser arranged for braking and an image forming device including the same, in accordance with the present invention, are described above, the scope of the invention is defined by the following claims.

What is claimed is:

1. A fuser arranged for braking, the fuser comprising a fusing member and a pressure member, wherein the fusing member and the pressure member cooperate to form a nip, the fuser arranged with an included sensor and an included pressure member braking means, the sensor indicating when a leading edge of an included paper sheet exits the nip and thereupon providing a sensor output signal to the pressure member braking means; the pressure member braking means providing, based on the sensor output signal, a braking action with respect to an included pressure member motion.

2. The fuser arranged for braking of claim 1 wherein the fusing member comprises a fusing roller.

3. The fuser arranged for braking of claim 1 wherein the fusing member comprises a fusing belt.

4. The fuser arranged for braking of claim 1 wherein the pressure member comprises a pressure roller.

5. The fuser arranged for braking of claim 1 wherein the pressure member comprises a pressure belt.

6. The fuser arranged for braking of claim 1 wherein, based on the braking action, the motion of the pressure member is thereby reduced, thus forming a reduced pressure member motion.

7. The fuser arranged for braking of claim 6 wherein, based on the reduced pressure member motion, the surface of the fusing member elastomer is caused to stretch, thus forming a stretched fusing member elastomer.

8. The fuser arranged for braking of claim 7 wherein, based on the stretched fusing member elastomer, the paper lead edge is thus peeled, severed, separated or stripped from the surface of the fusing member.

9. The fuser arranged for braking of claim 1 wherein the sensor comprises an optical sensor, a mechanical sensor, or both.

10. The fuser arranged for braking of claim 1 wherein the pressure member braking means comprises an electromagnetic brake or clutch device.

11. The fuser arranged for braking of claim 1 further including a stripping assisting arrangement comprising any of one or more air knives, one or more stripping fingers, or any combination of these items.

12. The fuser arranged for braking of claim 1 wherein the magnitude of the pressure member braking corresponds to a percentage of fusing member elastomer elongation that ranges between 0.1% and 20%.

13. The fuser arranged for braking of claim 1 wherein the duration or period of time during which the pressure member braking is applied is based on when the paper leading edge becomes satisfactorily stripped from the surface of the fusing member.

14. The fuser arranged for braking of claim 1 wherein the magnitude of the pressure member braking is constant with time.

15. The fuser arranged for braking of claim 1 wherein the magnitude of the pressure member braking varies with time.

16. An image forming device including a fuser arranged for braking, the fuser comprising a fusing member and a pressure member, wherein the fusing member and the pressure member cooperate to form a nip, the fuser arranged with an included sensor and an included pressure member braking means, the sensor indicating when a leading edge of an included paper sheet exits the nip and thereupon providing a sensor output signal to the pressure member braking means; the pressure member braking means providing, based on the sensor output signal, a braking action with respect to an included pressure member motion.

17. The image forming device of claim 16 wherein the fusing member comprises a fusing roller.

18. The image forming device of claim 16 wherein the fusing member comprises a fusing belt.

19. The image forming device of claim 16 wherein the pressure member comprises a pressure roller.

20. The image forming device of claim 16 wherein the pressure member comprises a pressure belt.

21. The image forming device of claim 16 wherein, based on the braking action, the motion of the pressure member is thereby reduced, thus forming a reduced pressure member motion.

22. The image forming device of claim 21 wherein, based on the reduced pressure member motion, the surface of the fusing member elastomer is caused to stretch, thus forming a stretched fusing member elastomer.

23. The image forming device of claim 22 wherein, based on the stretched fusing member elastomer, the paper lead edge is thus peeled, severed, separated or stripped from the surface of the fusing member.

24. The image forming device of claim 16 wherein the sensor comprises an optical, a mechanical sensor, or both.

25. The image forming device of claim 16 wherein the pressure member braking means comprises an electromagnetic brake or clutch device.

26. The image forming device of claim 16 further including a stripping assisting arrangement comprising any of one or more air knives, one or more stripping fingers, or any combination of these items.

27. The image forming device of claim 16 wherein the magnitude of the pressure member braking corresponds to a percentage of fusing member elastomer elongation that ranges between 0.1% and 20%.

28. The image forming device of claim 16 wherein the duration or period of time during which the pressure member braking is applied is based on when the paper leading edge becomes satisfactorily stripped from the surface of the fusing member.

29. The image forming device of claim 16 wherein the magnitude of the pressure member braking is constant with time.

30. The image forming device of claim 16 wherein the magnitude of the pressure member braking varies with time.

31. The image forming device of claim 16 comprising a printer or printing machine.

32. The image forming device of claim 16 comprising a copier or copying machine.

* * * * *